US010486027B1

(12) United States Patent
Ninomiya et al.

(10) Patent No.: US 10,486,027 B1
(45) Date of Patent: Nov. 26, 2019

(54) GOLF BALL

(71) Applicant: Mizuno Corporation, Osaka (JP)

(72) Inventors: Norikazu Ninomiya, Osaka (JP); Yudai Washida, Osaka (JP); Kensuke Maenaka, Osaka (JP); Kei Tsuji, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 16/250,132

(22) Filed: Jan. 17, 2019

(30) Foreign Application Priority Data

Oct. 2, 2018 (JP) ..... 2018-187609

(51) Int. Cl.
*A63B 37/12* (2006.01)
*A63B 37/00* (2006.01)
*A63B 102/32* (2015.01)

(52) U.S. Cl.
CPC ..... *A63B 37/0006* (2013.01); *A63B 37/0012* (2013.01); *A63B 37/0019* (2013.01); *A63B 2102/32* (2015.10)

(58) Field of Classification Search
CPC ..... A63B 37/0012
USPC ..... 473/383–384
See application file for complete search history.

(56) References Cited

U.S. PATENT DOCUMENTS 4,979,747 A 12/1990 Jonkouski
5,566,943 A * 10/1996 Boehm ..... A63B 37/0004 473/378
5,735,757 A * 4/1998 Moriyama ..... A63B 37/0004 473/384
5,902,193 A * 5/1999 Shimosaka ..... A63B 37/0004 473/379
2003/0190968 A1* 10/2003 Kasashima ..... A63B 37/0004 473/131
2006/0142098 A1* 6/2006 Sajima ..... A63B 37/0012 473/378

FOREIGN PATENT DOCUMENTS

JP H03198875 A 8/1991

* cited by examiner

*Primary Examiner* — Raeann Gorden
(74) *Attorney, Agent, or Firm* — Troutman Sanders LLP; Daniel Sharpe

(57) ABSTRACT

A golf ball includes a land portion, and a plurality of dimples configured to be recessed from the land portion. Each of the plurality of dimples includes a circular bottom face, a circular opening configured to have a larger diameter than the bottom face, and a side face configured to connect the bottom face and the opening. The side face is configured to be linearly inclined so that the diameter of each of the plurality of dimples increases from the bottom face toward the opening. The diameter of the bottom face is 0.45 mm or more and 0.60 mm or less.

3 Claims, 5 Drawing Sheets

GOLF BALL

This non-provisional application is based on Japanese Patent Application 2018-187609 filed on Oct. 2, 2018 with the Japan Patent Office, the entire contents of which are hereby incorporated by reference.

BACKGROUND OF THE INVENTION

Field of the Invention

The present invention relates to a golf ball.

Description of the Background Art

Up to now, in order to increase the flight distance of a golf ball, various dimples are provided on the surface of the golf ball. For example, Japanese Patent Laying-open No. 3-198875 describes a golf ball in which the side face of each dimple is formed into a truncated cone.

Even with such dimples provided on the golf ball as described in the above publication, it is difficult to sufficiently increase the flight distance.

SUMMARY OF THE INVENTION

The present invention has been made in view of the above problem, and an object thereof is to provide a golf ball capable of sufficiently increasing the flight distance.

The golf ball of the present invention includes a land portion, and a plurality of dimples configured to be recessed from the land portion. Each of the plurality of dimples includes a circular bottom face, a circular opening configured to have a larger diameter than the bottom face, and a side face configured to connect the bottom face and the opening. The side face is configured to be linearly inclined so that the diameter of each of the plurality of dimples increases from the bottom face toward the opening. The diameter of the bottom face is 0.45 mm or more and 0.60 mm or less. Thereby, the inventors found that the flight distance may be increased sufficiently.

In the golf ball mentioned above, it is preferable that the plurality of dimples include a plurality of dimple groups having different shapes from each other, and the average value of the ratio of the depth of each dimple relative to the diameter of the opening of each dimple in each of the plurality of dimple groups is 0.056 or more and 0.058 or less.

In the golf ball mentioned above, it is preferable that the average value of the ratio of the diameter of the bottom face relative to the diameter of the opening of each dimple in each of the plurality of dimple groups is 0.12 or more and 0.18 or less.

As described in the above, according to the golf ball of the present invention, it is possible to sufficiently increase the flight distance.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, an embodiment of the present invention will be described with reference to the drawings.

Figure 1:
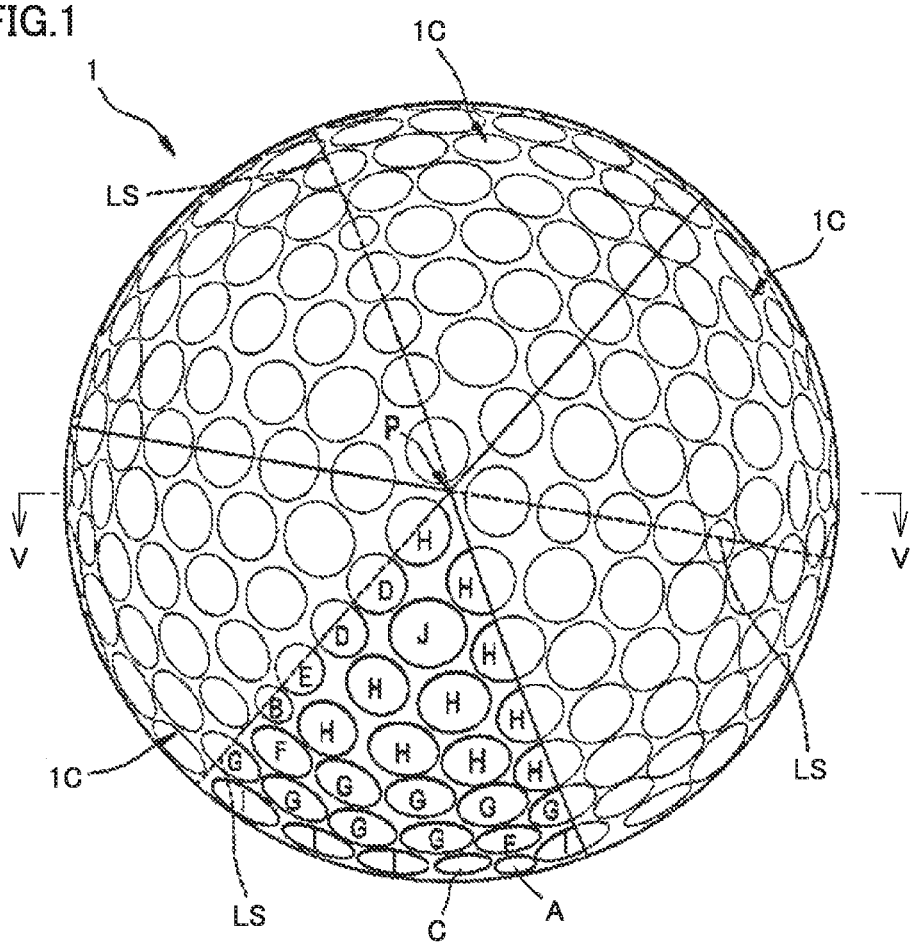
FIG. 1 is a schematic top view illustrating a golf ball according to an embodiment of the present invention.
Figure 2:
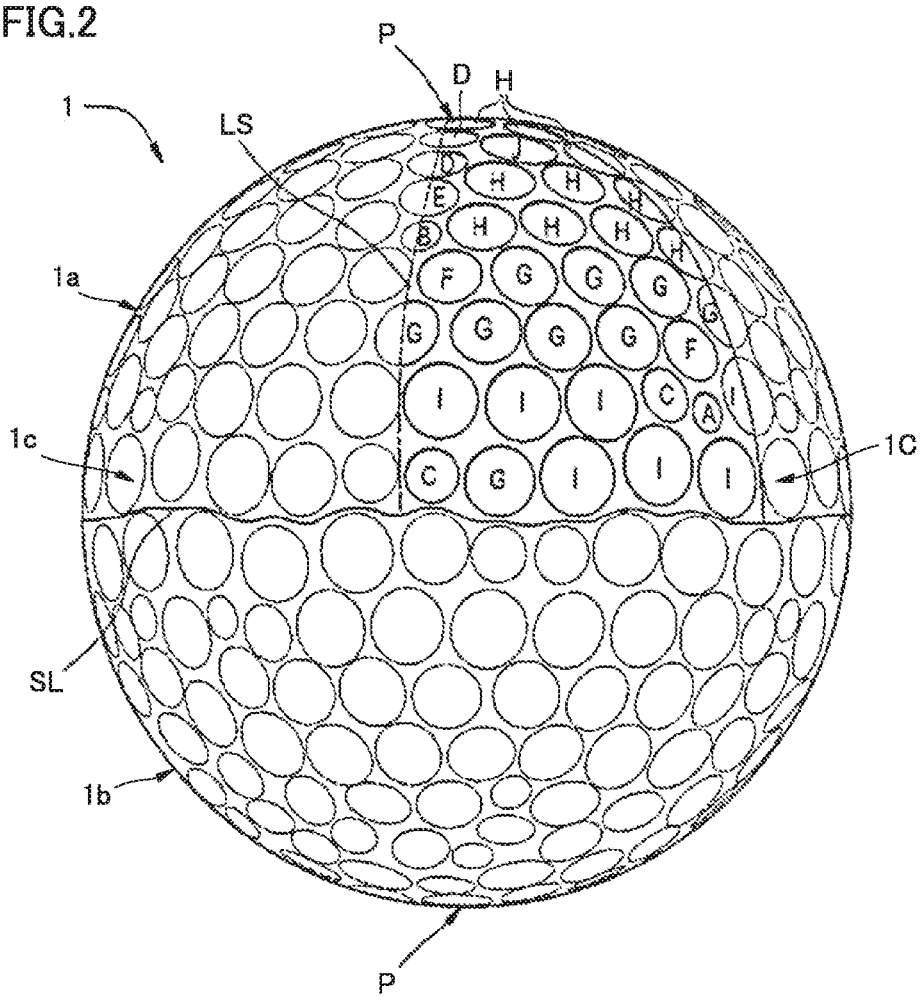
FIG. 2 is a schematic front view illustrating a golf ball according to an embodiment of the present invention.

First, with reference to FIG. 1 and FIG. 2, the pattern of dimples of a golf ball according to an embodiment of the present invention will be described. A golf ball 1 according to an embodiment of the present invention includes a land portion 2 and a plurality of dimples 3.

The land portion 2 is provided on the surface between the plurality of dimples 3. The land portion 2 is formed on the surface by connecting portions arranged between three adjacent dimples 3 in the plurality of dimples 3. No dimple 3 is formed on the land portion 2.

The plurality of dimples 3 are formed on the surface of the golf ball 1. The plurality of dimples 3 are configured to be recessed from the land portion 2. Each of the plurality of dimples 3 is configured to be recessed from the land portion 2 toward the center of the golf ball 1. Each of the plurality of dimples 3 is formed to have a circular shape in plan view.

The plurality of dimples 3 include a plurality of dimple groups. The plurality of dimple groups have different shapes from each other. The plurality of dimples 3 includes a first dimple A, a second dimple B, a third dimple C, a fourth dimple D, a fifth dimple E, a sixth dimple F, a seventh dimple G, an eighth dimple H, a ninth dimple I, and a tenth dimple J as the plurality of dimple groups.

The number of the plurality of dimples 3 is, for example, 310 or more and 400 or less. The number of the plurality of dimples 3 may be, for example, 360. The number of the first dimples A is, for example, 12. The number of the second dimples B is, for example, 6. The number of the third dimples C is, for example, 24. The number of the fourth dimples D is, for example, 12. The number of the fifth dimples E is, for example, 6. The number of the sixth dimples F is, for example, 24. The number of the seventh dimples G is, for example, 96. The number of the eighth dimples H is, for example, 90. The number of the ninth dimples I is, for example, 78. The number of the tenth dimples J is, for example, 12.

The golf ball 1 includes a first hemisphere 1*a* and a second hemisphere 1*b*. Each of the first hemisphere 1*a* and the second hemisphere 1*b* is formed in a substantially hemispherical shape. The bottom of the first hemisphere 1*a* and the bottom of the second hemisphere 1*b* are provided in a curved shape. The bottom of the first hemisphere 1*a* and the bottom of the second hemisphere 1*b* correspond to a seam line SL. The seam line SL does not coincide with the great circle of the golf ball 1.

Each of the first hemisphere 1*a* and the second hemisphere 1*b* includes three zones 1*c* equally arranged around a pole P. Thus, a total of six zones 1*c* are arranged on the entire surface of the golf ball 1. Each zone 1*c* is arranged in the range of 120° around the outer periphery of the golf ball 1. Each zone 1*c* is a spherical triangular region. The three zones 1*c* in the first hemisphere 1*a* share the pole P of the first hemisphere 1*a*. The three zones 1*c* in the second hemisphere 1*b* share the pole P of the second hemisphere 1*b*. The mutually adjacent zones 1*c* share a plurality of dimples 3 located at the boundary between the adjacent zones 1*c*. In each zone 1*c*, the dimples 3 arranged in a half region on one side of a symmetrical line LS are in line symmetry with the dimples 3 arranged in the other half region on the other side of the symmetrical line LS relative to the symmetrical line LS.

The arrangement of the dimples 3 (dimple pattern) in the first hemisphere 1*a* is substantially the same as the arrangement of the dimples 3 (dimple pattern) in the second hemisphere 1*b*. The dimple pattern in the first hemisphere 1*a* and the dimple pattern in the second hemisphere 1*b* are shifted by about 10° from each other in the rotation direction relative to the seam line SL on the boundary. In the golf ball 1 illustrated in FIGS. 1 and 2, a total number of 360 dimples 3 are provided. Each zone 1*c* is provided with a number of 30 dimples 3. Thus, a number of 15 dimples 3 are provided in each of the half regions on both sides of the symmetrical line LS for each zone 1*c*.

Figure 3:
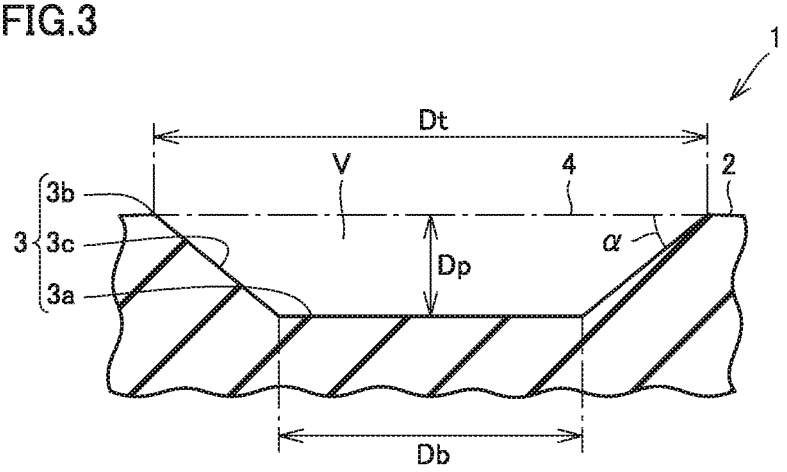
FIG. 3 is a schematic sectional view illustrating a dimple of a golf ball according to an embodiment of the present invention.
Figure 4:
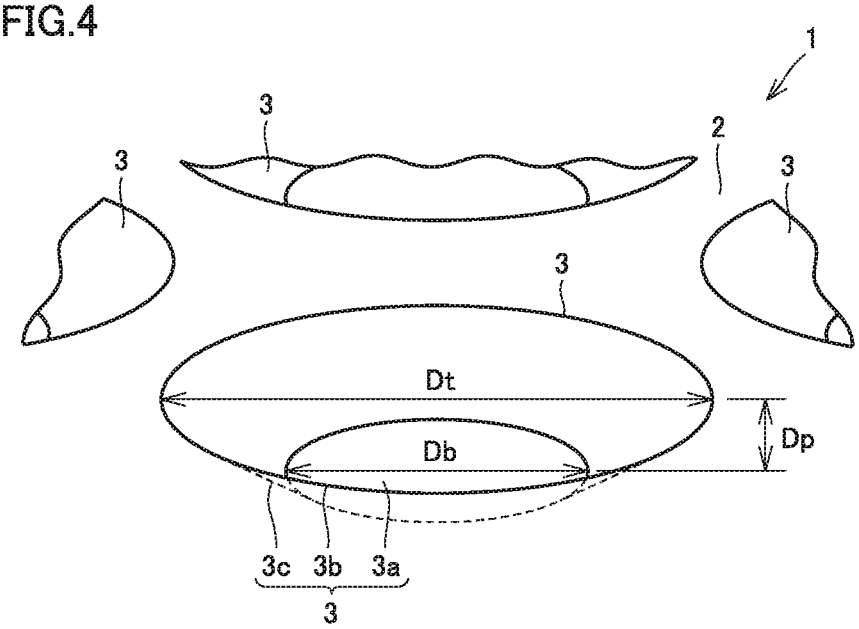
FIG. 4 is a schematic perspective view illustrating a dimple of a golf ball according to an embodiment of the present invention.

With reference to FIGS. 3 and 4, the configuration of each of the plurality of dimples 3 will be described in more detail. In a cross section passing through the center of the bottom face of each of the plurality of dimples 3 and the center of the golf ball 1, when a line joining the section lines of each dimple so as to cover the cross section of the dimple is drawn, contact points between the joining line and two ends of the section lines of each dimple are called edges of the dimple 3. The distance between the joining line and the deepest part of the dimple 3 is the depth of the dimple 3. The distance of the joining line between the contact points is the diameter of the dimple 3. The area of a plane defined by a circle passing through the contact points is the area of the dimple 3. The volume of a space surrounded by the plane defined by the circle passing through the contact points and the surface of the dimple 3 represents the volume of the dimple 3.

Each of the plurality of dimples 3 includes a bottom face 3*a*, an opening 3*b*, and a side face 3*c*. The bottom face 3*a* is formed to have a circular shape. The opening 3*b* is also formed to have a circular shape. The opening 3*b* is defined by the circle passing through the contact points. The opening 3*b* has a larger diameter than the bottom face 3*a*.

The side face 3*c* is configured to connect the bottom face 3*a* and the opening 3*b*. The side face 3*c* is linearly inclined so that the diameter of each of the plurality of dimples 3 increases from the bottom face 3*a* toward the opening 3*b*. The side face 3*c* is formed linearly in the cross section of the dimple. The side face 3*c* is inclined at a constant angle (cross-section angle) with respect to the joining line in the cross section of the dimple. The cross-section angle is an angle formed between the joining line and the side face 3*c* in the cross section of the dimple. In other words, when the opening 3*b* is represented by a virtual plane 4, the cross-section angle is an angle $\alpha$ formed between the virtual plane 4 and the side face 3*c*.

Specifically, the dimple 3 is formed in such a manner that a space surrounded by the surface of the dimple 3 and the plane represented by the circle passing through the edges of the dimple 3 is in the shape of a truncated cone. In other words, the dimple 3 is formed in such a manner that the space surrounded by the surface of the dimple 3 and the plane represented by the circle passing through the edges of the dimple 3 is in the shape of a frustum.

The diameter Dt of the dimple 3 is the distance between the contact points between the joining line and both ends of the section line of the dimple. The diameter Dt of the dimple 3 is the diameter of the plane defined by the circle passing through the edges of the dimple 3. The diameter Dt of the dimple 3 is the diameter Dt of the opening 3*b*.

The diameter Db of the bottom face 3*a* of the dimple 3 is the distance between the contact points between the bottom face 3*a* and the side face 3*c* in the cross section of the dimple 3. The diameter Db of the bottom face 3*a* of the dimple 3 is, for example, 0.50 mm or more and 0.55 mm or less. The diameter Db of the bottom face 3*a* of the dimple 3 may be, for example, 0.45 mm or more and 0.60 mm or less. The average value of the ratio of the diameter Db of the bottom face 3*a* relative to the diameter Dt of the opening 3*b* of each dimple in each of the plurality of dimple groups is 0.147 or more and 0.162 or less. The average value of the ratio of the diameter Db of the bottom face 3*a* relative to the diameter Dt of the opening 3*b* of each dimple in each of the plurality of dimple groups may be 0.12 or more and 0.18 or less. The depth Dp of the dimple 3 is the shortest distance between the joining line and the deepest part of the dimple 3. In other words, the depth Dp of the dimple 3 is the shortest distance in the radial direction of the golf ball 1 between the center of the bottom face of the dimple 3 and the plane defined by the circle passing through the edges of the dimple 3. The average value of the ratio of the depth Dp relative to the diameter Dt of the opening 3*b* of each dimple in each of the plurality of dimple groups may be 0.056 or more and 0.058 or less.

The volume V of the dimple 3 is defined by a space surrounded by the surface of the dimple 3 and the plane defined by the circle passing through the edges of the dimple 3. The volume V of the dimple 3 is the volume of a space surrounded by the surface of the side face 3*c*, the surface of the bottom face 3*a* and the plane defined by the circle passing through the edges of the dimple 3.

The diameter Dt of the first dimple A may be, for example, 2.40 mm. The depth Dp of the first dimple A is, for example, 0.215 mm or more and 0.222 mm or less. The volume V of the first dimple A is, for example, 0.405 $mm^3$ or more and 0.429 $mm^3$ or less. The ratio of the depth Dp relative to the diameter Dt of the opening 3*b* of the first dimple A if, for example, 0.089 or more and 0.093 or less. The ratio of the diameter Db of the bottom face 3*a* relative to the diameter Dt of the opening 3*b* of the first dimple A is, for example, 0.208 or more and 0.229 or less.

The diameter Dt of the second dimple B is, for example, 2.40 mm. The depth Dp of the second dimple B is, for example, 0.226 mm or more and 0.234 mm or less. The volume V of the second dimple B is, for example, 0.427 $mm^3$ or more and 0.451 $mm^3$ or less. The ratio of the depth Dp relative to the diameter Dt of the opening 3*b* of the second dimple B is, for example, 0.094 or more and 0.097 or less. The ratio of the diameter Db of the bottom face 3*a* relative to the diameter Dt of the opening 3*b* of the second dimple B is, for example, 0.208 or more and 0.229 or less.

The diameter Dt of the third dimple C is, for example, 3.32 mm. The depth Dp of the third dimple C is, for example, 0.147 mm or more and 0.152 mm or less. The volume V of the third dimple C is, for example, 0.499 $mm^3$ or more and 0.523 $mm^3$ or less. The ratio of the depth Dp relative to the diameter Dt of the opening 3*b* of the third dimple C is, for example, 0.044 or more and 0.046 or less. The ratio of the diameter Db of the bottom face 3*a* relative to the diameter Dt of the opening 3*b* of the third dimple C is, for example, 0.151 or more and 0.166 or less.

The diameter Dt of the fourth dimple D is, for example, 3.32 mm. The depth Dp of the fourth dimple D is, for example, 0.158 mm or more and 0.163 mm or less. The volume V of the fourth dimple D is, for example, 0.535 $mm^3$ or more and 0.562 $mm^3$ or less. The ratio of the depth Dp relative to the diameter Dt of the opening 3*b* of the fourth dimple D is, for example, 0.048 or more and 0.049 or less. The ratio of the diameter Db of the bottom face 3*a* relative to the diameter Dt of the opening 3*b* of the fourth dimple D is, for example, 0.151 or more and 0.166 or less.

The diameter Dt of the fifth dimple E is, for example, 3.53 mm. The depth Dp of the fifth dimple E is, for example, 0.203 mm or more and 0.210 mm or less. The volume V of the fifth dimple E is, for example, 0.770 $mm^3$ or more and 0.808 $mm^3$ or less. The ratio of the depth Dp relative to the diameter Dt of the opening 3*b* of the fifth dimple E is, for example, 0.058 or more and 0.059 or less. The ratio of the diameter Db of the bottom face 3*a* relative to the diameter Dt of the opening 3*b* of the fifth dimple E is, for example, 0.142 or more and 0.156 or less.

The diameter Dt of the sixth dimple F is, for example, 3.76 mm. The depth Dp of the sixth dimple F is, for example, 0.144 mm or more and 0.149 mm or less. The volume V of the sixth dimple F is, for example, 0.615 $mm^3$ or more and 0.644 $mm^3$ or less. The ratio of the depth Dp relative to the diameter Dt of the opening 3*b* of the sixth dimple F is, for example, 0.038 or more and 0.040 or less. The ratio of the diameter Db of the bottom face 3*a* relative to the diameter Dt of the opening 3*b* of the sixth dimple F is, for example, 0.133 or more and 0.146 or less.

The diameter Dt of the seventh dimple G is, for example, 4.02 mm. The depth Dp of the seventh dimple G is, for example, 0.169 mm or more and 0.176 mm or less. The volume V of the seventh dimple G is, for example, 0.817 $mm^3$ or more and 0.859 $mm^3$ or less. The ratio of the depth Dp relative to the diameter Dt of the opening 3*b* of the seventh dimple G is, for example, 0.042 or more and 0.044 or less. The ratio of the diameter Db of the bottom face 3*a* relative to the diameter Dt of the opening 3*b* of the seventh dimple G is, for example, 0.124 or more and 0.137 or less.

The diameter Dt of the eighth dimple H is, for example, 4.02 mm. The depth Dp of the eighth dimple H is, for example, 0.181 mm or more and 0.187 mm or less. The volume V of the eighth dimple H is, for example, 0.873 $mm^3$ or more and 0.914 $mm^3$ or less. The ratio of the depth Dp relative to the diameter Dt of the opening 3*b* of the eighth dimple H is, for example, 0.045 or more and 0.047 or less. The ratio of the diameter Db of the bottom face 3*a* relative to the diameter Dt of the opening 3*b* of the eighth dimple H is, for example, 0.124 or more and 0.137 or less.

The diameter Dt of the ninth dimple I is, for example, 4.39 mm. The depth Dp of the ninth dimple I is, for example, 0.226 mm or more and 0.234 mm or less. The volume V of the ninth dimple I is, for example, 1.286 $mm^3$ or more and 1.344 $mm^3$ or less. The ratio of the depth Dp relative to the diameter Dt of the opening 3*b* of the ninth dimple I is, for example, 0.052 or more and 0.053 or less. The ratio of the diameter Db of the bottom face 3*a* relative to the diameter Dt of the opening 3*b* of the ninth dimple I is, for example, 0.114 or more and 0.125 or less.

The diameter Dt of the tenth dimple J is, for example, 4.39 mm. The depth Dp of the tenth dimple J is, for example, 0.238 mm or more and 0.245 mm or less. The volume V of the tenth dimple J is, for example, 1.352 $mm^3$ or more and 1.410 $mm^3$ or less. The ratio of the depth Dp relative to the diameter Dt of the opening 3*b* of the tenth dimple J is, for example, 0.054 or more and 0.056 or less. The ratio of the diameter Db of the bottom face 3*a* relative to the diameter Dt of the opening 3*b* of the tenth dimple J is, for example, 0.114 or more and 0.125 or less.

The diameter Dt of each of the plurality of dimples 3 is, for example, 2 mm or more and 5 mm or less. The diameter Dt of each of the plurality of dimples 3 may be 2.40 mm or more and 4.39 mm or less. If the diameter Dt of the dimple 3 is made smaller, the dimple effect decreases, and if the diameter Dt of the dimple 3 is made larger, the gap between the dimples 3 increases, and thereby the dimple effect decreases.

The depth Dp of each of the plurality of dimples 3 is, for example, 0.12 mm or more and 0.28 mm or less. The depth Dp of each of the plurality of dimples 3 may be 0.144 mm or more and 0.247 mm or less. If the depth Dp of the dimple 3 is shallow, the golf ball 1 tends to rise excessively, and if the depth Dp of the dimple 3 is deep, the golf ball 1 tends to drop easily.

Next, the configuration of a golf ball according to an embodiment of the present invention will be described.

The diameter of the golf ball is required to be 42.67 mm or more according to the regulations (see R & A and USGA). However, in consideration of aerodynamic characteristics and the like, it is preferable that the diameter of a golf ball is made as small as possible, and for example, it may be 42.7 to 43.7 mm. Meanwhile, the weight of the golf ball is required to be 45.93 g or less according to the regulations. In consideration of aerodynamic characteristics, it is preferable that the weight of the golf ball is made as great as possible, and for example, it may be 45.2 g or more and 45.93 g or less.

Figure 5:
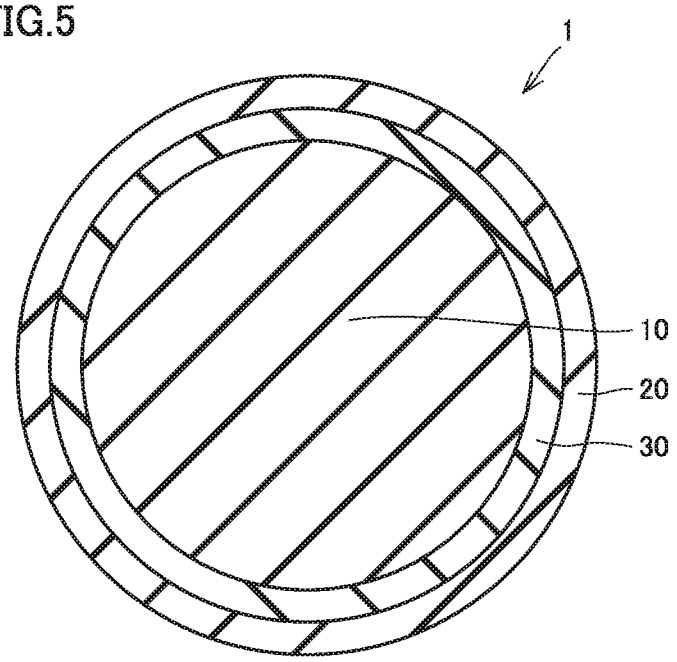
FIG. 5 is a schematic cross-sectional view taken along line V-V in FIG. 1.

With reference to FIG. 5, the golf ball 1 is provided with a core 10, a cover 20, and an intermediate layer 30. The core 10 is covered by the cover 20 and the intermediate layer 30. The intermediate layer 30 is covered by the cover 20. The golf ball 1 may be further provided with a paint layer and a mark layer outside the cover 20, but these layers are not illustrated in the drawings for convenience of explanation.

The core 10 is generally formed to have a spherical shape. However, it is acceptable that a plurality of evenly separated protrusions or uniformly distributed grooves are provided on the surface of the spherical core 10. When the protrusions are provided, it is preferable that the concaves partitioned by the protrusions are filled with a plurality of enveloping layers or a single enveloping layer covering each of the concaves, so that the shape of the body formed by the core 10 and the enveloping layer is spherical. When the grooves are provided, it is preferable that the grooves are filled with an outer layer covering the core 10 so that the final shape is spherical.

The core 10 is formed into a spherical shape. The core 10 is made of a rubber composition. The diameter of the core 10 is, for example, 38.3 mm. The weight of the core 10 is, for example, 33.7 g. If the core 10 is too small, the repulsion performance of the ball decreases, and if the core 10 is too large, the thickness of the cover 20 and the intermediate layer 30 covering the core 10 is too small, which decreases the durability of the ball, or the ball becomes too soft, which decreases the repulsion performance of the ball.

The core 10 may be prepared from a rubber composition containing a base rubber, a crosslinking agent, a metal salt of unsaturated carboxylic acid, a filler and the like. As the base rubber, for example, polybutadiene may be used. As the crosslinking agent, for example, dicumyl peroxide may be used. As the metal salt of unsaturated carboxylic acid, for example, zinc acrylate may be used. As the filler, for example, zinc oxide or magnesium carbonate may be used.

The cover 20 is made of an elastomer. The surface of the cover 20 is provided with a plurality of dimples (see FIG. 1).

The diameter of the cover 20 is, for example, 42.7 mm. As the material for the cover 20, thermoplastic polyurethane may be used.

The cover 20 may be formed by adopting any of known methods such as an injection molding method, a compression molding method, a cast molding method, and the like. The plurality of dimples (see FIG. 1) may be formed on the surface of the cover 20 when molding the cover 20. After the molding, processes of deburring, cleaning, polishing, painting and mark printing are carried out as necessary, and thereby, a golf ball is prepared.

The intermediate layer 30 is provided between the core 10 and the cover 20. The intermediate layer 30 may be a single layer or two or more layers. The diameter of the intermediate layer 30 may be, for example, 40.5 mm. The weight of the intermediate layer 30 may be, for example, 38.8 g. As a material of the intermediate layer 30, an ionomer may be used.

Next, the functions and effects of the golf ball 1 according to an embodiment of the present invention will be described.

In the golf ball 1 according to an embodiment of the present invention, each of the plurality of dimples 3 includes a circular bottom face 3*a*, a circular opening 3*b* configured to have a diameter larger than the bottom face, and a side face 3*c* configured to connect the bottom face 3*a* and the opening 3*b*. The side face 3*c* is linearly inclined so that the diameter of each of the plurality of dimples 3 increases from the bottom face 3*a* toward the opening 3*b*. The diameter Db of the bottom face 3*a* is 0.45 mm or more and 0.60 mm or less. Thereby, the inventors found that the flight distance may be increased sufficiently.

In addition, the plurality of dimples 3 include a plurality of dimple groups having different shapes from each other. The average value of the ratio of the depth Dp relative to the diameter Dt of the opening 3*b* of each dimple in each of the plurality of dimple groups is 0.056 or more and 0.058 or less. Thereby, the inventors found that the flight distance may be sufficiently increased.

The average value of the ratio of the diameter Db of the bottom face 3*a* relative to the diameter Dt of the opening 3*b* of each dimple in each of the plurality of dimple groups is 0.12 or more and 0.18 or less. Thereby, the inventors found that the flight distance may be sufficiently increased.

EXAMPLES

Hereinafter, examples of the present invention will be described in comparison with comparative examples. Note that the same reference numerals are assigned to the same or corresponding parts as those in the embodiment of the present invention described above, and the description thereof will not be repeated.

The golf ball according to each of Examples 1 and 2 and the golf ball according to each of Comparative Examples 1 to 4 were prepared. Table 1 shows the configuration of the golf ball according to each of Comparative Examples 1 to 4. Table 2 shows the configuration of the golf ball according to each of Examples 1 and 2. The configuration of the golf ball according to each of Examples 1 and 2 and the configuration of the golf ball according to each of Comparative Examples 1 to 4 will be described with reference to Tables 1 and 2.

TABLE 1

| | | | Comparative Example 1 | | Comparative Example 2 | | | | |
|---|---|---|---|---|---|---|---|---|---|
| No | Dimples | Dt (mm) | Dp (mm) | V ($mm^3$) | Db (mm) | Dp (mm) | V ($mm^3$) | Dp/Dt | Db/Dt |
| A | 12 | 2.40 | 0.164 | 0.378 | 0.35 | 0.197 | 0.347 | 0.082 | 0.146 |
| B | 6 | 2.40 | 0.164 | 0.378 | 0.35 | 0.208 | 0.365 | 0.086 | 0.146 |
| C | 24 | 3.32 | 0.160 | 0.610 | 0.35 | 0.135 | 0.435 | 0.041 | 0.105 |
| D | 12 | 3.32 | 0.172 | 0.656 | 0.35 | 0.145 | 0.467 | 0.044 | 0.105 |
| E | 6 | 3.53 | 0.221 | 0.936 | 0.35 | 0.186 | 0.674 | 0.053 | 0.099 |
| F | 24 | 3.76 | 0.157 | 0.742 | 0.35 | 0.132 | 0.540 | 0.035 | 0.093 |
| G | 96 | 4.02 | 0.185 | 0.983 | 0.35 | 0.155 | 0.720 | 0.039 | 0.087 |
| H | 90 | 4.02 | 0.197 | 1.047 | 0.35 | 0.166 | 0.769 | 0.041 | 0.087 |
| I | 78 | 4.39 | 0.246 | 1.528 | 0.35 | 0.208 | 1.137 | 0.047 | 0.080 |
| J | 12 | 4.39 | 0.258 | 1.603 | 0.35 | 0.218 | 1.195 | 0.050 | 0.080 |
| Sum | 360 | — | — | 379.78 | — | — | 280.7 | — | — |
| Average | — | 3.56 | — | — | 0.35 | 0.175 | 26.123 | 0.052 | 0.103 |

| | Comparative Example 3 | | | | | Comparative Example 4 | | | | |
|---|---|---|---|---|---|---|---|---|---|---|
| No | Db (mm) | Dp (mm) | V ($mm^3$) | Dp/Dt | Db/Dt | Db (mm) | Dp (mm) | V ($mm^3$) | Dp/Dt | Db/Dt |
| A | 0.25 | 0.187 | 0.315 | 0.078 | 0.104 | 0.65 | 0.240 | 0.486 | 0.100 | 0.271 |
| B | 0.25 | 0.197 | 0.331 | 0.082 | 0.104 | 0.65 | 0.236 | 0.478 | 0.098 | 0.271 |
| C | 0.25 | 0.128 | 0.399 | 0.039 | 0.075 | 0.65 | 0.155 | 0.552 | 0.047 | 0.196 |
| D | 0.25 | 0.138 | 0.430 | 0.041 | 0.075 | 0.65 | 0.167 | 0.593 | 0.050 | 0.196 |
| E | 0.25 | 0.177 | 0.623 | 0.050 | 0.071 | 0.65 | 0.214 | 0.850 | 0.061 | 0.184 |
| F | 0.25 | 0.126 | 0.500 | 0.034 | 0.066 | 0.65 | 0.151 | 0.670 | 0.040 | 0.173 |
| G | 0.25 | 0.148 | 0.669 | 0.037 | 0.062 | 0.65 | 0.177 | 0.891 | 0.044 | 0.162 |
| H | 0.25 | 0.158 | 0.713 | 0.039 | 0.062 | 0.65 | 0.189 | 0.949 | 0.047 | 0.162 |
| I | 0.25 | 0.197 | 1.053 | 0.045 | 0.057 | 0.65 | 0.236 | 1.392 | 0.054 | 0.148 |
| J | 0.25 | 0.207 | 1.110 | 0.047 | 0.057 | 0.65 | 0.247 | 1.460 | 0.056 | 0.148 |
| Sum | — | — | 254.9 | — | — | — | — | 347.4 | — | — |
| Average | 0.25 | 0.1664 | 23.731 | 0.049 | 0.073 | 0.65 | 0.201 | 0.832 | 0.060 | 0.191 |

TABLE 2

| | | | Example 1 | | | | | Example 2 | | | | |
|---|---|---|---|---|---|---|---|---|---|---|---|---|
| No. | Dimples | Dt (mm) | Db (mm) | Dp (mm) | V ($mm^3$) | Dp/Dt | Db/Dt | Db (mm) | Dp (mm) | V ($mm^3$) | Dp/Dt | Db/Dt |
| A | 12 | 2.40 | 0.50 | 0.215 | 0.405 | 0.089 | 0.208 | 0.55 | 0.222 | 0.429 | 0.093 | 0.229 |
| B | 6 | 2.40 | 0.50 | 0.226 | 0.427 | 0.094 | 0.208 | 0.55 | 0.234 | 0.451 | 0.097 | 0.229 |
| C | 24 | 3.32 | 0.50 | 0.147 | 0.499 | 0.044 | 0.151 | 0.55 | 0.152 | 0.523 | 0.046 | 0.166 |
| D | 12 | 3.32 | 0.50 | 0.158 | 0.535 | 0.048 | 0.151 | 0.55 | 0.163 | 0.562 | 0.049 | 0.166 |
| E | 6 | 3.53 | 0.50 | 0.203 | 0.770 | 0.058 | 0.142 | 0.55 | 0.210 | 0.808 | 0.059 | 0.156 |
| F | 24 | 3.76 | 0.50 | 0.144 | 0.615 | 0.038 | 0.133 | 0.55 | 0.149 | 0.644 | 0.040 | 0.146 |
| G | 96 | 4.02 | 0.50 | 0.169 | 0.817 | 0.042 | 0.124 | 0.55 | 0.176 | 0.859 | 0.044 | 0.137 |
| H | 90 | 4.02 | 0.50 | 0.181 | 0.873 | 0.045 | 0.124 | 0.55 | 0.187 | 0.914 | 0.047 | 0.137 |
| I | 78 | 4.39 | 0.50 | 0.226 | 1.286 | 0.052 | 0.114 | 0.55 | 0.234 | 1.344 | 0.053 | 0.125 |
| J | 12 | 4.39 | 0.50 | 0.238 | 1.352 | 0.054 | 0.114 | 0.55 | 0.245 | 1.410 | 0.056 | 0.125 |
| Sum | 360 | — | — | — | 312.4 | — | — | — | — | 327.3 | — | — |
| Average | — | 3.56 | 0.50 | 0.191 | 29.089 | 0.056 | 0.147 | 0.55 | 0.1971 | 30.477 | 0.058 | 0.162 |

The golf ball according to each of Examples 1 and 2 of the present invention has the same configuration as the golf ball according to the embodiment of the present invention described above. In other words, with reference to FIG. 1 again, the plurality of dimples 3 includes a first dimple A, a second dimple B, a third dimple C, a fourth dimple D, a fifth dimple E, a sixth dimple F, a seventh dimple G, an eighth dimple H, a ninth dimple I, and a tenth dimple J in each dimple group. In Table 1, No. A to J correspond to the first dimple A to the tenth dimple J, respectively. The number of dimples in Table 1 is the number of the first dimple A to the tenth dimple J, respectively. The other symbols in Table 1 and Table 2 correspond to those described above in the embodiment of the present invention.

The golf ball according to each of Comparative Examples 1 to 4 is provided with a plurality of dimples similarly to the golf ball according to the embodiment of the present invention described above. In the golf ball according to Comparative Example 1, each of the plurality of dimples is configured to be recessed in a hemispherical shape from the land portion toward the center of the golf ball. The golf ball according to each of Comparative Examples 2 to 4 is provided with a plurality of dimples different in shape from those provided in the golf ball according to the embodiment of the present invention described above.

In order to determine the flight distance of each golf ball, a carry (in yards) was measured by using the golf ball according to each of Examples 1 and 2 and the golf ball according to each of Comparative Examples 1 to 4. The carry was measured by using a golf robot manufactured by Miyamae Corporation. A golf club was set on the golf robot, and the golf ball according to each of Examples 1 and 2 and the golf ball according to each of Comparative Examples 1 to 4 were hit with the golf club so as to measure the carry. The carry is defined as a distance from a location where the golf ball is hit to another location where the golf ball firstly drops on the ground. As the golf club, a driver JPX 900 manufactured by Mizuno Corporation was used. The head speed (HS) of the golf club was set to about 40 m/s. The carry was calculated as the average value of five balls hit. Table 3 shows the carry of the golf ball according to each of Examples 1 and 2 and the carry of the golf ball according to each of Comparative Examples 1 to 4.

TABLE 3

| | Carry (yard) |
|---|---|
| Comparative Example 1 | 201.0 |
| Comparative Example 2 | 200.5 |
| Comparative Example 3 | 199.8 |
| Comparative Example 4 | 201.2 |
| Example 1 | 203.7 |
| Example 2 | 205.1 |

With reference to Table 3, the golf ball according to each of Examples 1 and 2 had a larger carry than the golf ball according to Comparative Example 1. In addition, the golf ball according to each of Examples 1 and 2 had a larger carry than the golf ball according to each of Comparative Examples 2 to 4. Therefore, it was obvious that the golf ball according to each of Examples 1 and 2 of the present invention may sufficiently increase the flight distance.

The embodiments and examples disclosed herein are illustrative and non-restrictive in any respect. The technical scope indicated by the claims is intended to include any modifications within the scope and meaning equivalent to the terms of the claims.

What is claimed is:

1. A golf ball comprising:

a land portion; and a plurality of dimples configured to be recessed from the land portion, each of the plurality of dimples including:

a circular bottom face;

a circular opening configured to have a larger diameter than the bottom face; and a side face configured to connect the bottom face and the opening, the side face being configured to be linearly inclined so that the diameter of each of the plurality of dimples increases from the bottom face toward the opening, and the diameter of the bottom face being 0.45 mm or more and 0.60 mm or less.

2. The golf ball according to claim 1, wherein the plurality of dimples include a plurality of dimple groups having different shapes from each other, and the average value of the ratio of the depth of each dimple relative to the diameter of the opening of each dimple in each of the plurality of dimple groups is 0.056 or more and 0.058 or less.

3. The golf ball according to claim 2, wherein the average value of the ratio of the diameter of the bottom face relative to the diameter of the opening of each dimple in each of the plurality of dimple groups is 0.12 or more and 0.18 or less.

* * * * *